US006953199B2

(12) United States Patent
Malloy, III

(10) Patent No.: US 6,953,199 B2
(45) Date of Patent: Oct. 11, 2005

(54) CONTAINER ASSEMBLY WITH SUPPLEMENTARY SUPPORT STRUCTURE

(76) Inventor: John Cyril Malloy, III, 2800 SW. 3rd Ave., Pinecrest, FL (US) 33547

( * ) Notice: Subject to any disclaimer, the term of this patent is extended or adjusted under 35 U.S.C. 154(b) by 0 days.

(21) Appl. No.: 10/751,591

(22) Filed: Jan. 5, 2004

(65) Prior Publication Data

US 2004/0178592 A1 Sep. 16, 2004

Related U.S. Application Data

(60) Continuation of application No. 10/156,460, filed on May 28, 2002, now abandoned, which is a continuation of application No. 09/947,066, filed on Sep. 5, 2001, now abandoned, which is a division of application No. 09/294,648, filed on Apr. 19, 1999, now abandoned.

(51) Int. Cl.[7] ..... B65F 1/14

(52) U.S. Cl. ..... 280/47.26; 280/47.18; 280/33.996; 280/47.19; 220/908; 220/629

(58) Field of Search ..... 280/33.996, 79.2, 280/47.131, 47.19, 47.23, 47.26, 47.27, 47.28, 47.35, 47.31; 220/908, 909, 629, 729

(56) References Cited

U.S. PATENT DOCUMENTS 369,695 A 9/1887 Curtis
2,964,328 A 12/1960 Muir (Continued)

*Primary Examiner*—Christopher R. Ellis
*Assistant Examiner*—Jeff Restifo
(74) *Attorney, Agent, or Firm*—Malloy & Malloy, P.A.

(57) ABSTRACT

A container assembly designed for the collection, temporary storage and transport of refuse, waste material or other objects including a housing having a hollow interior in which the refuse is collected and stored and further including a supplementary support structure movably mounted on the housing and selectively positionable between an operative position and a stored position. The supplementary support structure is at least partially defined by a support platform which, when in the operative position, extends outwardly from a sidewall or other exterior surface portion of the housing and is structured to support and have mounted thereon one or more objects or containers of additional refuse material, etc. such that diverse objects or materials may be stored and transported both interiorly of the housing and exteriorly thereof, thereby increasing the capacity of the materials or objects stored on and transported by the container assembly while maintaining the objects or materials in a segregated relation to one another. The supplementary support structure, in certain embodiments of the present invention, may be disposed in a retracted orientation to define the stored position when the storage or transport of objects or materials on the exterior of the housing is not intended or required. Further, the housing is at least partially tapered such that at least two container assemblies can be concentrically stacked within one another when the supplementary support is in its stored position.

5 Claims, 4 Drawing Sheets

U.S. PATENT DOCUMENTS 3,052,484 A 9/1962 Huffman et al.
4,821,903 A 4/1989 Hayes
4,840,531 A 6/1989 Dinneen
4,893,722 A 1/1990 Jones
4,944,419 A * 7/1990 Chandler ..... 220/502
4,988,010 A 1/1991 Pollak
5,028,099 A 7/1991 Bertucco
5,058,957 A 10/1991 Fell
5,090,785 A 2/1992 Stamp
5,129,543 A * 7/1992 White ..... 220/503
5,174,468 A 12/1992 Holderman
5,295,607 A 3/1994 Chang
5,398,838 A 3/1995 Dosunmu
5,480,170 A 1/1996 Kaiser, II
5,628,424 A * 5/1997 Gola ..... 220/495.07
5,690,217 A 11/1997 Friday
5,713,499 A 2/1998 Daniel
5,730,451 A 3/1998 Walker
5,772,384 A 6/1998 Richards
5,845,915 A 12/1998 Wilson
5,873,643 A 2/1999 Burgess, Jr. et al.
5,931,483 A 8/1999 Haynes
6,062,416 A * 5/2000 Smillie ..... 220/524
6,134,826 A 10/2000 Mah
6,176,499 B1 1/2001 Conrado et al.
6,179,306 B1 1/2001 Maxwell
6,296,132 B1 * 10/2001 Pickler ..... 220/1.5
6,568,555 B1 * 5/2003 LoCascio ..... 220/495.07
6,607,088 B2 * 8/2003 Cestrone ..... 220/23.86
6,688,614 B2 * 2/2004 Hsu ..... 280/37

* cited by examiner

CONTAINER ASSEMBLY WITH SUPPLEMENTARY SUPPORT STRUCTURE

CLAIM OF PRIORITY

The present application is a continuation application of previously filed application having Ser. No. 10/156,460, which was filed on May 28, 2002 now abandoned which is also a continuation application of previously filed now abandoned application having Ser. No. 09/947,066, which was filed on Sep. 5, 2001, which is a divisional application of previously filed, now abandoned application having Ser. No. 09/294,648, filed on Apr. 19, 1999.

BACKGROUND OF THE INVENTION

1. Field of the Invention

The present invention relates to a container assembly designed to store and transport garbage, waste and/or other types of materials. More in particular, the container assembly of the present invention is structured to store and permit the transport of waste and related objects in a segregated fashion by maintaining a first variety of collected materials on the interior of the container assembly and at least a second variety of collected objects exteriorly thereof, by way of a supplementary support structure mounted on the container assembly so as to move therewith. The supplementary support structure is preferably permanently mounted on the container assembly, and further, so as to be movable between an operative position and a stored position.

2. Description of the Related Art

In the field of waste collection and management, there has been in recent years an increasing demand for the separation of those objects which are capable of being recycled from other types of domestic waste material which are not capable of being readily recycled. Typically, materials which are recycled demonstrate poor biodegradable characteristics and include glass, plastics, aluminum cans, other products made of metal, etc. Many urban communities now follow recycling programs, wherein individuals are strongly urged or even required to separate these and other types of recyclable materials, such as newspapers, and to store them in separate, recyclable containers or bins, apart from the more general, domestic waste materials which are dumped into conventional garbage or waste containers. Oftentimes, these separate, recyclable bins are readily provided by the community governments to the individuals, and further, in addition to being marked with color or other indicia, are sized to be relatively small and carriable by hand, so that individuals will readily use them in an intended fashion.

Usually, the procedure associated with the collection of domestic waste involves each individual living within an urban community having to physically transport or move his or her garbage cans or other conventional refuse containers, as well as the containers or bins intended for the collection of recyclable materials, to a curb side location or other designated location. Large waste collection vehicles, commonly known as garbage trucks are then scheduled to periodically travel along a given route, and while doing so, pick up the garbage from the various refuse containers disposed at the curb side location.

While such waste collection systems are thought to offer a vast improvement over those of eras gone by, in terms of helping to avoid both disease and pestilence problems associated with rotting garbage, there is still an inconvenience associated with having to transport all of the collected refuse or garbage, including recyclable items, to the curb side or other location for pick up. To alleviate such problems, many conventional types of garbage cans or other refuse containers are structured to be mobile, and therefore, include a wheel assembly designed to movably support the garbage container and its contents as it travels over the ground or other supporting surface. While such known refuse containers alleviate somewhat the inconvenience associated with transporting the collected waste to the curb or other location for disposal, there still remains the problem of having to transport the one or more additional containers used to collect recyclable objects, which are maintained separately from those waste materials not intended to be recycled and which are usually just deposited into a conventional garbage can. Accordingly, an individual living within a community which follows a recycling program is often forced to make at least one additional trip, and perhaps more, to the curb or other garbage pick-up location in order to transport the containers used for the temporary collection of materials intended to be recycled from the initial storage location in his or her home. While it might appear to be a minor inconvenience, as a practical matter the requiring of an individual to make two or three trips for the transport of a plurality of different refuse containers to the curb side or other garbage pick-up location becomes a significant deterrent in accomplishing the consistent collection and segregation of materials which may be recycled from other types of domestic waste or refuse of a general nature.

In recognition of the above described inconvenience associated with transporting to the garbage pick-up location both the general domestic waste materials and those objects intended to be recycled, there have been attempts to design holders or carriers which are specifically structured for the collection of either a variety of non-biodegradable and recyclable materials directly or alternatively, for the storage of the bins which are used to collect such items. Some of these known, specialized refuse containers have also been structured to be mobile, so as to facilitate transport thereof over the ground or like supporting surface. However, even these more specialized carrier devices for recyclable items still require that an individual make more than one trip from his or her home to the garbage pick-up site because of the fact that the conventional garbage containers, wherein the general, non-recyclable waste materials are deposited, must also be transported to the curb of other location for pick-up given that in many communities, trash pick up of both recyclable and non-recyclable waste occurs on the same day.

Another attempt to overcome the inconvenience discussed above includes an "after-market" attachment device, which is designed to be removably secured to a larger, conventional refuse container so as to support the smaller, specialized collection bin provided by the community governments on the larger, conventional garbage container. On the one hand, and assuming that such a device is operative for the intended purpose, only a single trip may be required from the location where garbage and/or the waste bins are stored to the location where the containers are emptied into the waste management vehicles. On the other hand, even this type of device suffers from certain inherent disadvantages which render it somewhat impractical. Specifically, it is believed that the known attachment structures require some adjustment in order to hold or carry a recycling bin, that they also make it difficult to load and unload a bin which is full of recyclable waste, and further, that it is necessary to attach and remove such attachment structures from the conventional refuse container each time a trip is made to or from the curb side location. As such, the known after market, add-on attachment devices do not satisfactorily address the convenience issues discussed above, and therefore, might not be used on a consistent basis. In addition, such after market, attachment devices are not structurally adapted to be mounted on all of the large variety of conventional refuse containers, most of which have a different design, size and/or configuration. Moreover, it is not uncommon for a user to own more than one type of conventional garbage container, with the result that the known, after market, add-on devices would be highly unlikely to be mounted on each of the refuse containers owned by a user.

As a result of the inconveniences associated with the separate collection of a variety of different waste materials, and the fact that devices known in the art fail to adequately overcome those inconveniences, there are many individuals who do not follow the appropriate and intended procedures for separating from general domestic waste material those materials deemed by a community to be easily recycled and worthy of a concentrated recycling program. Consequently, although efforts are underway to cause less harm to the environment by way of recycling selected items, including non-biodegradable waste, these efforts are being impeded by the fact that there remain a few fairly significant inconveniences associated with the collection and disposal of domestic waste, even when it has been separated into recyclable items.

Accordingly, there remains a need in the art for an improved container assembly which is structured to collect, temporarily store and transport general domestic waste materials, as well as recyclable waste materials collected in at least one recycling bin or a plurality of such bins or other separate recycling containers. Any such improved container assembly should be capable of segregating the general domestic waste from the recyclable waste, and further, of storing and transporting the segregated waste materials both interiorly and exteriorly of the container. Any such improved container assembly should overcome the inconveniences and other disadvantages associated with the segregated collection of recyclable materials, and in particular, should permit an individual to make only a single trip from a point of initial collection and temporary storage of the waste material to a location for disposal or pick-up of such collected waste materials.

SUMMARY OF THE INVENTION

The present invention is designed to address the needs which remain in the art and relates to a container assembly structured to store a collection of a variety of materials such as, but not exclusively limited to, refuse, waste, garbage, and the like. The container assembly of the present invention comprises a housing having a hollow interior in which a first variety of materials or objects are intended to be collected and temporarily stored, such as but not limited to, general domestic waste material. In addition, the container assembly of the present invention comprises a supplementary support structure, preferably in the form of a support platform, which is either fixedly or movably mounted at least partially on the exterior of the housing, and which is disposed and structured to support a second variety of materials or objects, such as, but not limited to recyclable waste materials which may be contained in at least one bin or other container intended for the storage and temporary collection of such objects. Preferably, the container assembly of the present invention also includes a wheel assembly or other means for facilitating the transport of the container assembly, and any materials or objects carried thereby, from an individual's home to another location, such as a garbage pick-up site. Accordingly, the invention is preferably structured to collect, temporarily store and transport at least a first and second different variety of materials in a segregated manner both interiorly and exteriorly of the housing of the container assembly.

In one preferred embodiment of the present invention, the supplementary support structure of the container assembly comprises a support platform, described in greater detail hereinafter, which is movably mounted on the housing so as to be selectively positionable between an operative position and a stored position. The supplementary support structure is preferably permanently mounted to the housing but could also take the form of an after market, attachment device which is easily mounted on and removed from the housing. The operative position is preferably defined at least in part by the preferred support platform extending outwardly from a sidewall or other exterior portion of the housing, ideally in a generally transverse orientation. In the stored position, the preferred support platform preferably assumes a substantially collapsed or retracted position, wherein the support platform takes up relatively little or almost no additional space, other than that occupied by the housing of the container assembly itself. Further, when in its operative position, and virtually regardless of the specific preferred embodiment of the container assembly of the present invention contemplated, the support platform is independently structured and cooperatively secured to the housing so as to support at least a predetermined amount of weight, such as that generally equivalent to a weight typically associated with one or more specialized storage bins carrying a collection of recyclable materials. As set forth above, such materials may include but are not limited to newspapers, plastics, glass bottles or jars, aluminum and metal cans, etc. While in its operative position, the support platform preferably extends substantially transversely outward from an exterior portion of the housing at what may be considered a generally perpendicular angle to a central longitudinal axis of the container. It should be noted, however, that the support platform may extend outwardly at other preferred angles which serve to maintain the additional container or bins of recyclable materials on the support platform, exteriorly of the housing, particularly when the container assembly of the present invention is being moved across the ground or other supporting surface, as intended. In order to reduce the possibility of such containers or other materials inadvertently falling off the support platform, particularly during transport of the container assembly, additional retainer structures, such as but not limited to a upstanding lip or flange, may be formed on or associated with the support platform. As briefly mentioned above, the stored position may be defined by the supplementary support structure being disposed in an immediately adjacent, overlying disposition and/or in a substantially aligned or generally parallel orientation relative to an exposed surface of a sidewall of the housing. To achieve movement between the operative and stored positions, the supplementary support structure is, in the most preferred embodiment, pivotally or otherwise movably connected, such as at one end thereof, to the exterior of the housing, such that the support platform may be easily positioned into the outwardly extended operative position or into the stored position relative to a sidewall of the housing.

In yet another embodiment of the present invention, the supplementary support structure may assume another stored position. Specifically, the preferred support platform may be slidingly attached to a lower base portion of the housing of the container assembly, such as but not limited to, beneath a closed end portion of the housing located at the bottom of the container assembly. In this embodiment, substantially all or at least the majority of the length of the support platform defining at least a portion of the supplementary support structure would preferably be disposed within a receiving compartment disposed on the base portion or beneath the closed end of the housing of the container assembly, and only extended outwardly therefrom when it is intended to place the support platform in the aforementioned operative position.

Yet another embodiment of the present invention includes an integral, one piece, unitary construction of the container assembly and supplementary support structure. In this embodiment, the support platform is preferably integrally secured to a portion of the housing on the container assembly which is adjacent to or part of a closed end or base of the housing, as discussed previously. Also in this embodiment, the supplementary support structure is not selectively positionable between the aforementioned operative and stored positions, but instead is continuously oriented in an outwardly extended position relative to a sidewall of the housing for the support and maintenance of the one or more containers, materials or objects on the exterior of the housing, as set forth above.

Therefore, it is a primary object of the present invention to provide a mobile container assembly primarily, but not exclusively, intended for the collection, temporary storage and transport of waste or refuse materials both interiorly and exteriorly thereof.

Another primary object of the present invention is to provide a mobile container assembly designed to store, collect and transport different varieties of waste materials or other objects in segregated relation to one another.

Yet another important object of the present invention is to provide a mobile container assembly including a supplementary support structure which is at least temporarily located exteriorly of the assembly's housing and which is structured for the support and transport of at least one additional container or bin, or if desired, of other materials, objects, etc.

Still another important object of the present invention is to provide a container assembly including a supplementary support structure mounted on the exterior of the housing and which is selectively positionable between a stored position and an operative position.

It is also an important object of the present invention to provide a mobile container assembly including a supplementary support structure, preferably in the form of a support platform integrally or fixedly secured to an exterior thereof, and which is structured to support and transport a first variety of materials or objects in segregated relation to a different variety of materials or objects stored and collected on the interior thereof.

Yet another object of the present invention is to provide a mobile container assembly specifically, but not exclusively, designed for the temporary storage and transport of waste or refuse material, and which in one embodiment incorporates a supplementary support structure which is permanently, but not necessarily integrally or fixedly attached to the exterior thereof, in a manner which eliminates the necessity for selective attachment or detachment of a support platform to the exterior of the container assembly.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
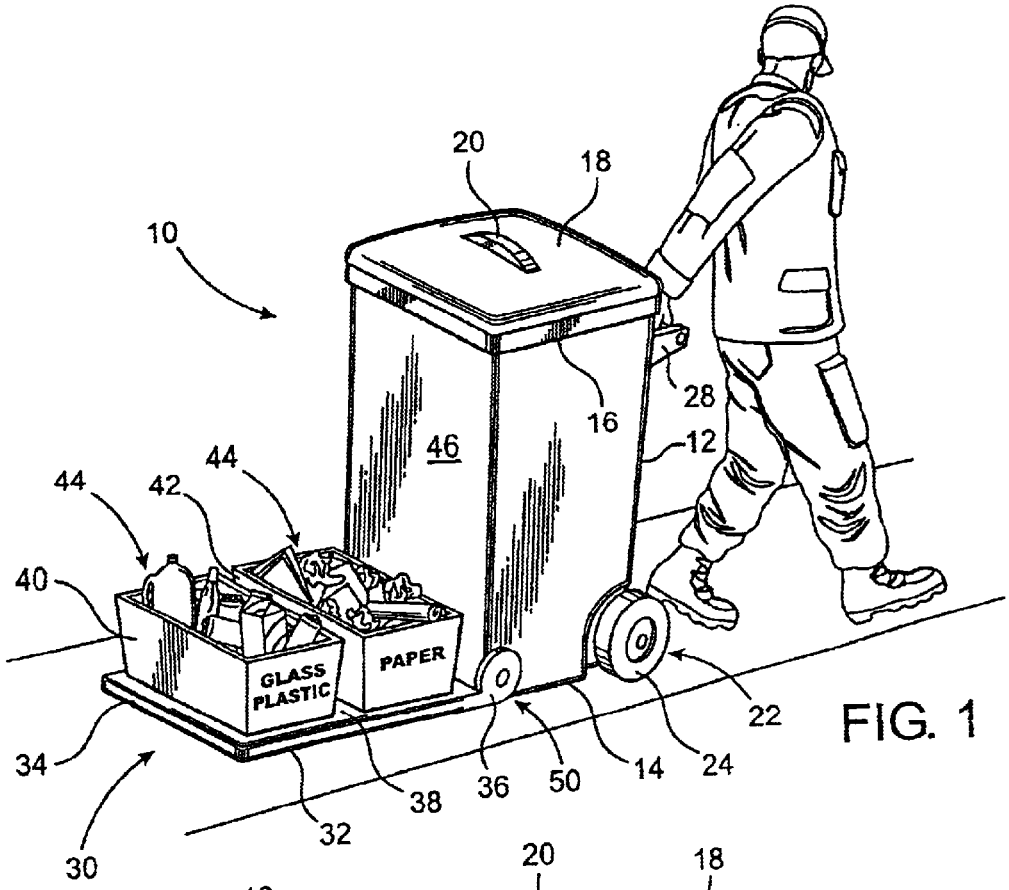
FIG. 1 is a perspective view of a container assembly according to the present invention in a first preferred embodiment and illustrating a supplementary support structure disposed in an operative position.
Figure 2:
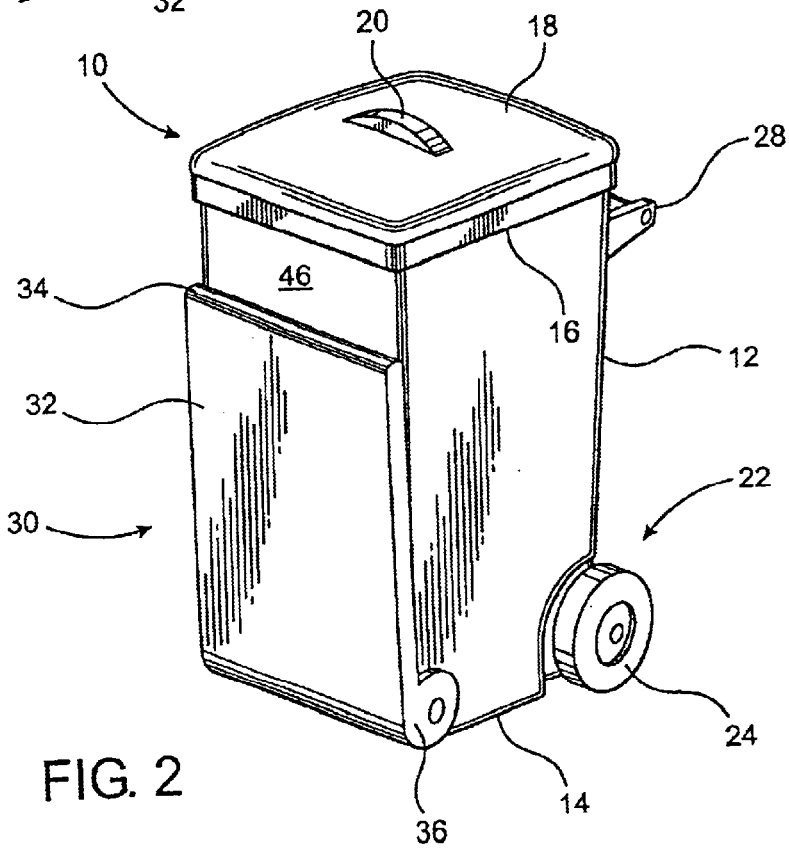
FIG. 2 is a perspective view of the embodiment shown in FIG. 1, wherein the supplementary support structure is disposed in a stored position.

As shown in the accompanying Figures, the present invention is directed towards a container assembly, indicated generally by reference numeral 10 in FIGS. 1 and 2, which is primarily, but not exclusively, intended for use in collecting, storing and transporting a variety of trash or garbage. The container assembly, generally indicated as 10, includes a housing 12 having a hollow interior and a closed end portion 14, which preferably, but not necessarily is located at the bottom end of the housing 12. The container assembly also includes an access opening 16 which communicates with the hollow interior of the housing, and which preferably is disposed at the opposite end of the housing 12. The access opening 16 is dimensioned and configured to facilitate the deposit and removal of a variety of materials or objects into and out of the hollow interior for the collection, temporary storage and eventual removal thereof. A lid structure 18 is preferably also provided, which ideally, is designed to be removably attached in overlying, covering relation to the access opening or open end 16 and further, which includes a handle, as at 20, to facilitate positioning of the cover structure 18 either on or off the housing 12. While the container assembly of the present invention is depicted in the various drawings as having a housing 12 with a multi-sided configuration, as is commonly found on most garbage cans, it is intended to be within the spirit and scope of the present invention to include a housing which has an exterior or sidewall configuration that is generally cylindrical or drum-like, or any one of a variety of other configurations.

Preferably, the container assembly 10 of the present invention is designed to be mobile, and accordingly, the housing 12 will additionally include a wheel assembly 22 or other means for facilitating rolling movement of the assembly over the ground or other support surface. The wheel assembly 22 may take the form of one or more wheels or roller structures 24 rotatably mounted on the housing 12, preferably adjacent to the lower, closed end 14, and disposed to supportingly engage the housing 12 on the ground or other supporting surface. Most preferably, the structure and disposition of the wheel assembly 22 is such as to allow the housing 12 to be positioned into an angled orientation, shown in FIG. 1, wherein a substantial part of the weight of the container assembly 10 is supported by the wheel assembly 22 as it travels over the ground or other supporting surface in order to transport the waste or refuse material contained within the housing 12 and/or exterior of the housing, to a site of disposal. Of course, the wheel assembly 22 may take a variety of configurations including a plurality of spaced apart wheels, as at 24, or a single, elongated wheel or roller structure located at and/or extending along one end of the container 10. Alternatively, a plurality of different wheel or roller structure sets may be mounted on or adjacent to the lower closed end 14 such that the entire housing is supported on the plurality of wheel or roller sets in at least minimally spaced relation above the ground or other surface over which the container assembly 10 is intended to travel. In addition, the container assembly 10 will preferably also include a handle 28, which may be either fixedly or movably mounted on an exterior portion of the housing, such as on a sidewall thereof, in order to facilitate the transport or movement of the container assembly 10 over the ground. The handle 28 is preferably also disposed and structured to facilitate the gripping thereof by an individual in order to assist with transporting of the container assembly 10 to a desired location.

Referring now to FIGS. 1 and 2, the container assembly of the present invention additionally comprises a supplementary support structure, generally indicated as 30. In this first preferred embodiment, the supplementary support structure 30 comprises a support platform 32 having an elongated configuration terminating in an outer or distal end 34, and a spaced apart, substantially opposed, proximal or inner end 36. The support platform 32 additionally includes an exposed support surface 38, which is preferably planar or substantially flat, although a variety of other configurations could be utilized, including a grooved exposed surface, to achieve the intended supporting of one or more recycling bins or other containers, as at 40 and 42. The recycling bins 40 and 42 may contain a variety of waste or refuse materials, generally indicated as 44, which will most likely be intended to be maintained in segregated relation from the general domestic waste material collected and temporarily stored within the hollow interior of housing 12. As set forth previously herein, it is common practice in many urban areas to separate certain types of waste material or objects 44 into, for example, those capable of being recycled and/or those having poor biodegradable characteristics, in order that recycling or another more suitable type of processing can be performed on such waste materials or objects, 44.

Additionally, and as shown in the first preferred embodiment of FIGS. 1 and 2, the supplementary support structure 30 of the present invention is movably mounted on the housing 12, most preferably so as to be capable of being selectively disposed or retracted between the operative position of FIG. 1 and the stored position of FIG. 2. In this embodiment, the operative position is defined by the supplementary support structure 30, and in particular, the support platform 32, assuming an outwardly extending, substantially transverse orientation relative to an exterior surface and/or sidewall portion 46 of the housing 12. While the preferred angular orientation of the support platform 32 may be generally considered to be perpendicular to a central, longitudinal axis of the housing 12, it is pointed out that other angular orientations are possible for an outwardly extending support platform 32 and that these other orientations are intended to fall within the spirit and scope of the present invention. Of course, the preferred angular orientations of the support platform 32 should be such as to facilitate or assure a reasonable stability of the containers 40 or 42 and/or waste materials 44, when they are supported on the exposed support surface 38 of the support platform 32, and particularly when the wheel assembly 22 is disposed in the manner and location represented in FIG. 1, such that it is necessary to orient the entire container assembly in a somewhat angled orientation as best shown in FIG. 1.

Still referring to FIGS. 1 and 2, the supplementary support structure 30 is preferably pivotally attached to the housing 12 of the container assembly 10, ideally at or adjacent a lower, exterior end of the housing 12, by means of a hinge mechanism or similar connection or attachment mechanism, as generally indicated by reference numeral 50. The hinge or like attachment mechanism 50 may, of course, assume a variety of structural configurations known in the art which would serve to pivotally or otherwise movably interconnect the support platform 32, to the exterior of the housing 12 so that it may be selectively positionable in either the operative position of FIG. 1 or the stored position of FIG. 2. As mentioned previously, the stored position illustrated in FIG. 2 is most preferably, but not necessarily, defined by the support platform 32 assuming a substantially aligned, adjacent and/or somewhat overlying orientation relative to an exterior portion of the housing 12, and ideally, to a sidewall portion 46 thereof. The hinge or like attachment mechanism may additionally be structured to include a latch or like stop structure (not shown) for temporarily but reasonably reliably maintaining the support platform 32 in either the stored position or the operative position. Most preferably, the latch or like stop structure would be utilized to temporarily maintain the support platform in the stored position so that a user, after transporting the container assembly 10 and waste materials contained therein to the curbside location with the support platform 32 disposed in the operative position shown in FIG. 1, could remove the bins holding the recyclable materials from the support platform 32, whereupon the support platform 32 could be moved to the stored position shown in FIG. 2, and utilize the latch or other stop structure to temporarily maintain the stored position. As such, a worker might more easily lift and empty the contents of the housing 12 into a garbage truck, without any interference or other obstruction caused by the support platform 32.

While the embodiment of the invention illustrated in FIGS. 1 and 2 is most preferably mounted in a permanent or at least semi-permanent manner on the housing 12, it is pointed out that the present invention could alternatively comprise a supplemental support structure capable of being easily mounted onto and removed from the housing 12. For example, the supplemental support structure might comprise a support platform, not shown but similar to that discussed previously, which is movably connected to the lower end of a ladder type of assembly, which assembly includes a hook like structure formed at an upper end thereof for being hooked onto the peripheral edge of a sidewall 46 of the container assembly 10, about the access opening 16. In this alternative embodiment, the ladder assembly would be sized to generally correspond to the length of the container assembly 10 or to be less that said length.

Figure 3:
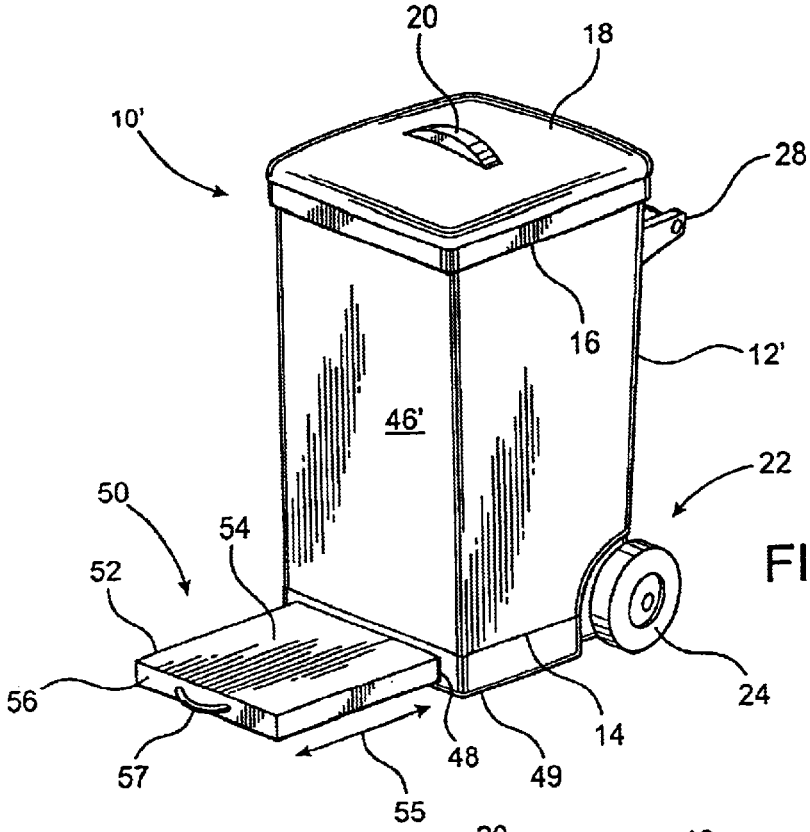
FIG. 3 is a perspective view of another preferred embodiment of the present invention wherein a supplementary support structure associated therewith is shown in an operative position.

With reference now to FIG. 3, another embodiment of the present invention is represented. In this embodiment, the container assembly 10' is also readily mobile, and further, also comprises a housing 12' having a hollow interior and an access opening in communication therewith. As with the first preferred embodiment, in this embodiment the access opening to the housing 12' may be defined by an open end 16 of the housing 12, and a cover or lid structure 18 will preferably be provided which is removably disposed in overlying relation thereto. The container assembly 10' of this embodiment also includes a supplementary support structure, generally indicated as 50, which also preferably comprises, at least in part, a support platform 52 having an exposed support surface 54 on which one or more specialized containers, such as recycling bins 40 and 42, having a variety of segregated waste materials 44 contained therein, may be placed, as explained with reference to the embodiment of FIGS. 1 and 2. Also, the preferred support platform 52 is also planar or substantially flat, although this could vary somewhat, and further, is ideally sized and configured to correspond generally to the cross sectional shape of the housing 12' of the container assembly, as will become more clear, below. In the embodiment of FIG. 3, however, the support platform 52 preferably communicates and is at least partially received within a base portion 49 formed on or fixedly secured to the housing 12' adjacent to or contiguous with the lower, closed end 14, thereof, as shown in the drawings. The base portion 49 will preferably include an interior compartment, not shown, which ideally, is dimensioned, configured and disposed to receive substantially all or at least a significant majority of the support platform 52 therein. In this embodiment the supplementary support structure 50, in the form of the preferred support platform 52, is slidably disposable into and out of a retracted or stored position relative to the receiving, interior compartment defined within the base portion 49, as indicated by directional arrow 55. A handle 57 may be secured to an outermost or distal end 56 of the support platform 52 in order to selectively position the support platform 52 between the aforementioned stored position and an operative position, such as that illustrated in FIG. 3. More specifically, in the operative position, the support platform 52 has at least the majority of its length extending outwardly from the base portion 49 so as to support one or more smaller, more specialized containers, such as recycling bins 40 and 42, and/or waste materials or objects 44 thereon, as described above. Further, the base portion 49 includes an open side, as at 48, which may communicate directly with the receiving compartment located within the interior of the base portion 49. The open side 48 may also be substantially aligned in somewhat adjacent relation to an outer sidewall or surface portion 46' of the housing 12' so as to facilitate a user having access to the support platform 52, when retracted and in its stored position.

Figure 4:
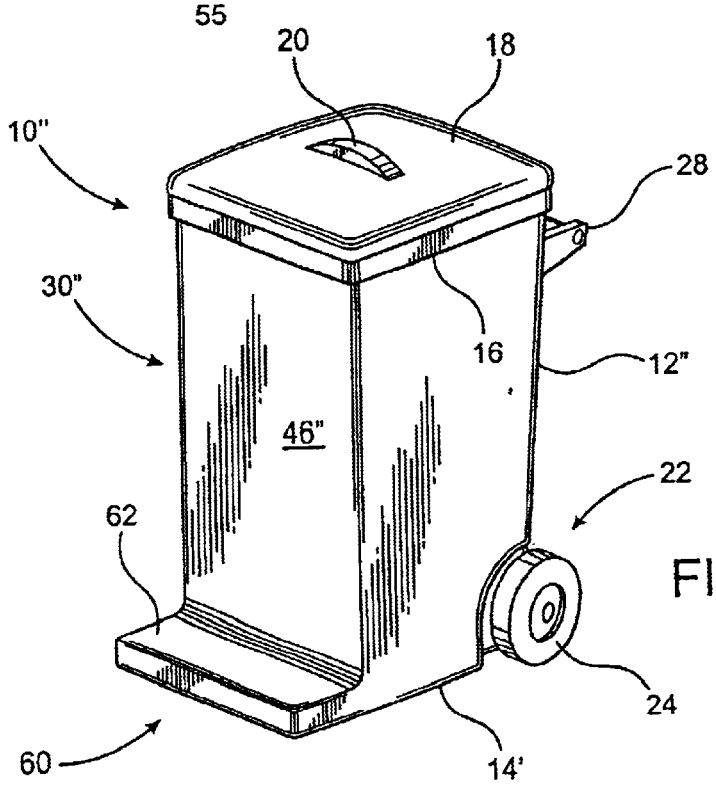
FIG. 4 is a perspective view of yet another preferred embodiment of the present invention wherein a supplementary support structure associated therewith is integrally and/or fixedly mounted in an operative position.

Yet another preferred embodiment of the present invention is shown in FIG. 4. In this embodiment, the container assembly 10" also has a supplementary support structure, generally indicated as 60, which is preferably either fixedly or integrally secured to the exterior of the housing 12", such as may be accomplished by an integral, one piece or unitized construction of the supplementary support structure 60 with and/or exteriorly of sidewall portion 46". In the embodiment of FIG. 4, the supplementary support structure 60 comprises an integrally formed support platform 62 which is maintained in an outwardly extended orientation relative to sidewall 46" of the housing. The outwardly extended orientation defines a permanent, operative position of the support platform 62, which further, may have a length sufficient to support one or more recycling bins 40 and 42, and/or waste materials or objects 44 thereon, as described above, or sufficient to only support a portion of one such bin and yet permit carrying thereof on the container assembly 10". In addition, it is again to be emphasized that the integral, unitized, construction of the embodiment of FIG. 4 can be accomplished utilizing a housing 12" having a cylindrical configuration or any number of other exterior surface configurations other than a multi-sided configuration such as that shown in FIG. 4.

Figure 5:
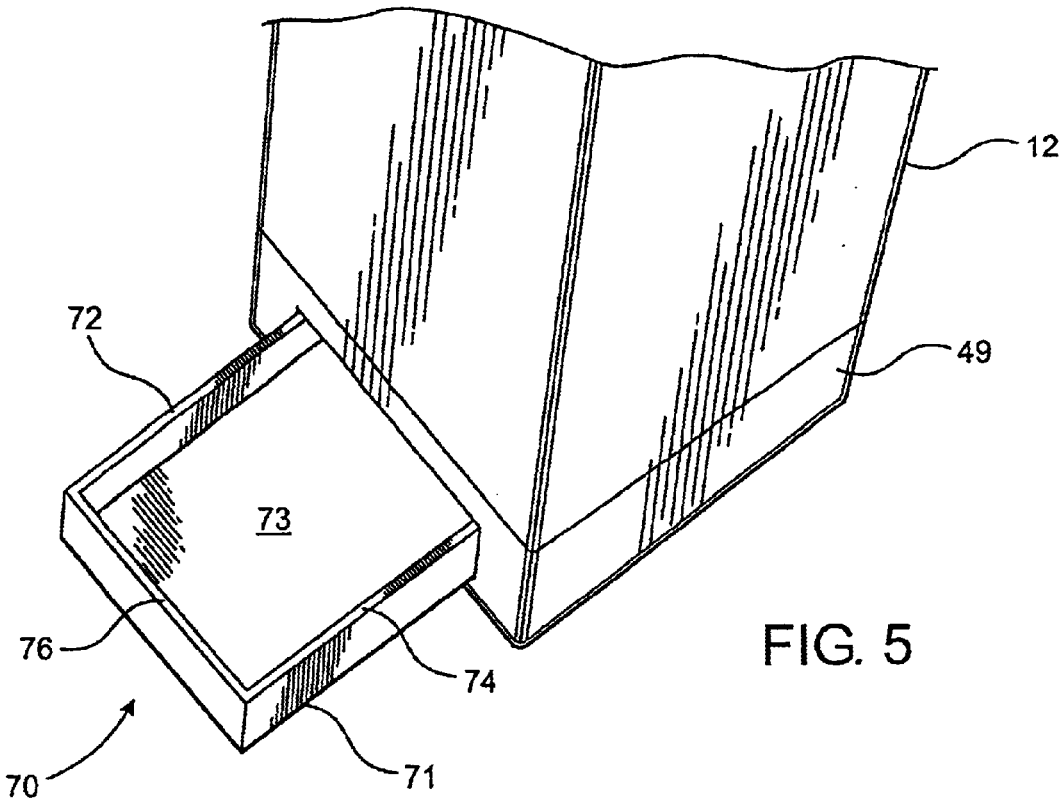
FIG. 5 is a perspective view in partial cut-away showing yet another embodiment directed to the supplementary support structure of the present invention.
Figure 6:
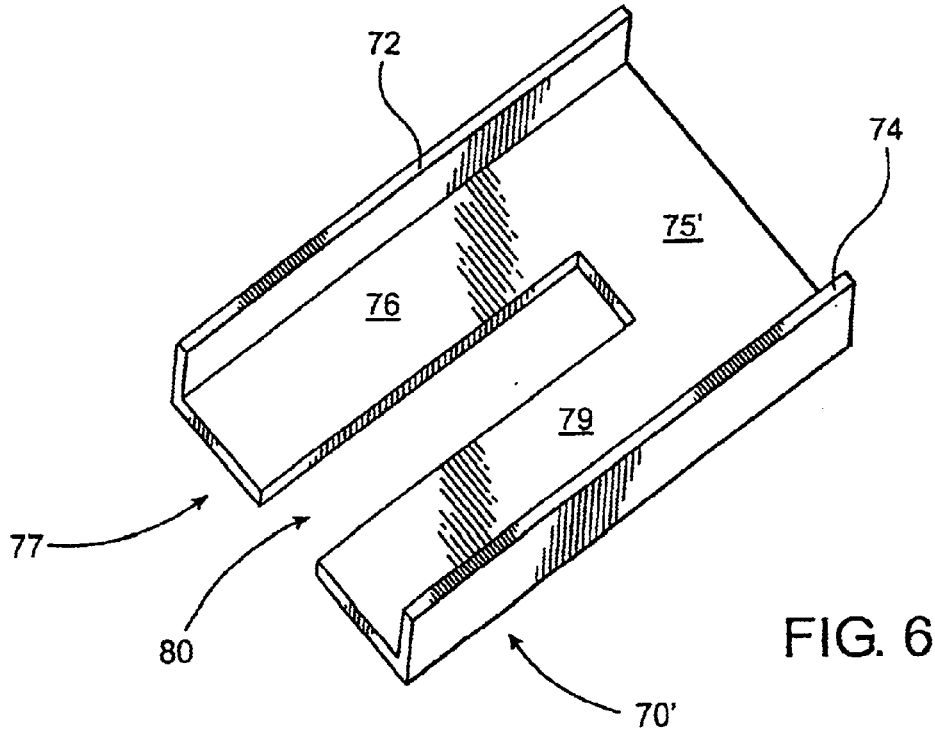
FIG. 6 is a perspective view in detail of yet another embodiment of the supplementary support structure associated with the mobile container assembly of the present invention.

With reference now to FIGS. 5 and 6, an additional structural feature is illustrated for a supplementary support structure according to the present invention, such as possessed by the embodiments of the invention shown in FIGS. 1 through 4, and indicated by reference numerals 30, 50 and 60. For example, the supplementary support structure may additionally comprise a retainer structure, generally indicated as 70 and/or 70', formed thereon in the nature of one or more, spaced-apart retaining flanges, 72 and 74 extending along the longitudinal sides 71 of the support platform 70 or 70', and further extending above the level of the exposed, support surface 73, 73'. In addition, in the embodiment of FIG. 5, the retainer structure may also include an additional retaining flange, as at 76, extending along the front edge and also above the level of the support surface 73 defined by support platform 71. The retaining flanges 72, 74 and 76 are provided to reduce the possibility of one or more containers, such as 40 and 42 in FIG. 1, and/or a variety of waste materials or objects supported on the surface 73, from inadvertently falling or being displaced therefrom.

With reference to FIG. 6, the supplementary support structure 70' is illustrated in another embodiment as having a bifurcated configuration. In this embodiment, the supplemental support structure 70' comprises a generally "U" shaped configuration defined by an open distal or outer end 77 having two leg portions, 78 and 79, separated by a void or space 80. The embodiment of FIG. 6, which will require less material to construct and which should permit the spillage of any liquids to pass more directly to the ground, may also include a retaining structure, such as retaining flanges 72, 74 and/or 76, about the outer periphery of the support structure 70', for the purpose outlined above with regard to the embodiment of FIG. 5.

It is also to be emphasized that a structural modification of the embodiments of FIGS. 3 and 5 may include the support platforms 50 and 70, respectively defining the supplementary support structures, being slidingly positioned in a retracted orientation directly beneath the closed end 14 of the housing 12 rather than within a receiving compartment on the interior of a base portion 49. Such a structural modification would further include sufficient structural integrity to adequately support a support platform when it is in either its stored position, directly beneath the closed end 14, or its operative position, extending outwardly from the housing 12, 12'. Another possible modification of the supplementary support structure of the present invention intended to be covered by the present invention would be to provide a container assembly with a combination of any two support structures, such as those embodied in of FIGS. 1 and 2, and/or of FIGS. 3 and 5.

For purposes of clarity, it is pointed out that the term "retracted," as utilized herein, is meant to describe the movement and/or positioning of the supplementary support structures shown in FIGS. 1 through 3, whether or not the supplementary support structure is pivotally or hingedly attached to the housing, shown in the embodiments of FIGS. 1 and 2, or slidingly moveable relative to the housing, shown in the embodiments of FIGS. 3, 5 and 6.

Figure 7:
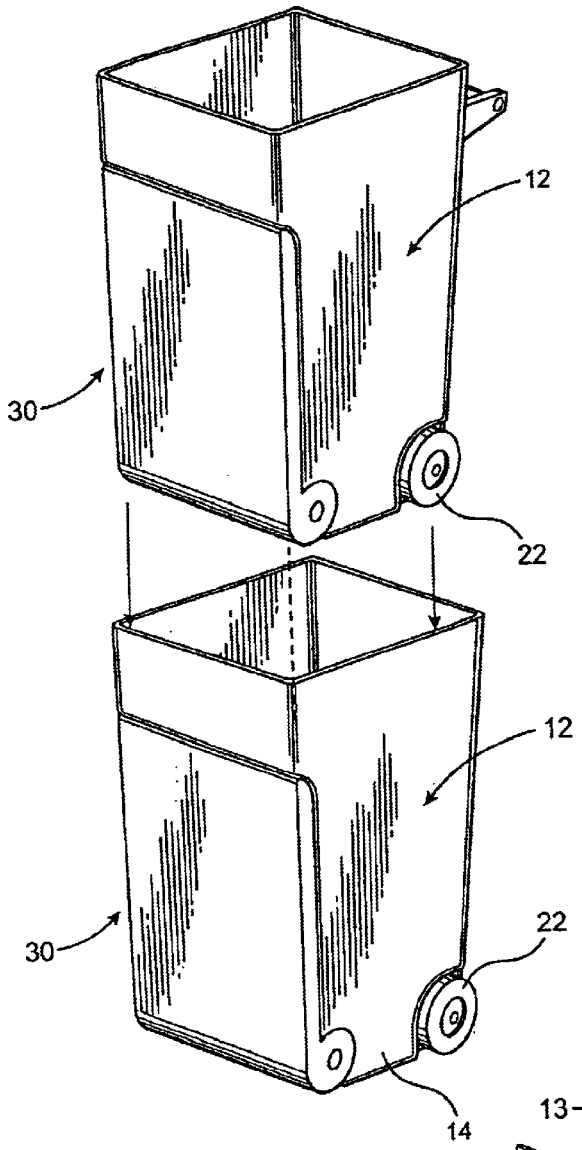
FIG. 7 is a perspective view of another embodiment of the present invention illustrating concentric stackability between two or more container assemblies.
Figure 8:
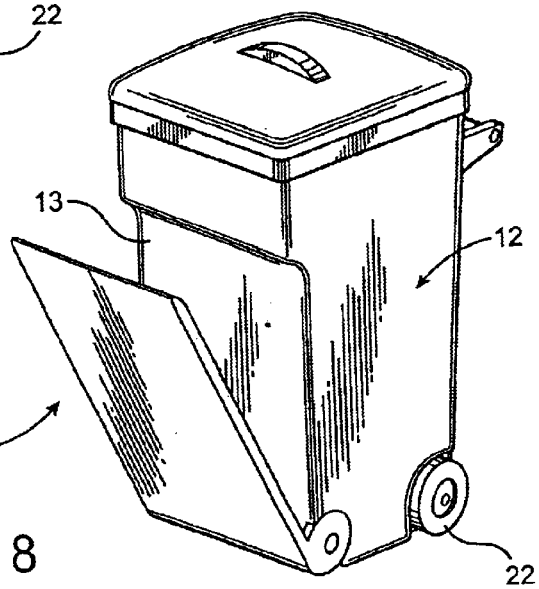
FIG. 8 is a perspective view of still another embodiment including a recess defined in said housing to facilitate stacking of multiple containers.

Turning to FIGS. 7 and 8, it is also noted than in yet another embodiment, at least a portion of the housing 12 is preferably tapered towards the closed end 14. Accordingly, for vending, transport and/or storage purposes, a plurality of the container assemblies 10 can be concentrically stacked within one another. Further, this tapering can be sufficient to allow for only a small degree of introduction, but in preferred embodiment, at least half, if not three quarters of one container assembly 10 will be contained within another container assembly so as to minimize the stacked height of the multiple container assemblies. Additionally, in an embodiment wherein a wheel assembly 22 is provided, it may also be preferred that the hollow interior of the housing 12 be configured so as to accommodate the wheel assembly 22 of a concentrically stacked container assembly. As such, one or more grooves, notches or tracks may be formed in the housing 12 in aligned relation with the wheel assembly 22 of a stacked container assembly 10. Alternately, as in FIG. 8, the wheel assembly may be disposed substantially beneath and/or overlapped by the closed end 14 of the housing 12 so as to minimize an overlap of an exterior dimension of the housing 12 defined at the closed end 14, and thereby not extend the exterior dimension which allows for concentric stacking. Finally, turning to the embodiment of FIG. 8, the housing 12 may also include a recess 13 defined therein. The recess 13 is preferably structured to accommodate the supplementary support 30 when in its stored position. In this way the exterior defined by the housing 12 and an underside of the supplementary support 30 are uniform and generally continuous so as to not interfere with concentric stacking of multiple container assemblies 10. It is noted that a lock structure may be provided in the recess 13 so as to maintain the supplementary support 30 in its stored position.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A container assembly for storing and transporting refuse, said assembly comprising:

a) a housing including a hollow interior and a closed end, said housing at least partially tapering towards said closed end, b) an access opening formed on said housing in communicating relation to said hollow interior, c) a supplementary support structure movably mounted on said housing and selectively positionable between an operative position and a stored position, d) said operative position comprising an outwardly extending orientation of said supplementary support structure relative to an exterior surface of said housing, e) said stored position comprising a substantially aligned, overlying orientation defined by said supplementary support structure being disposed adjacent to an exterior of said hollow interior of said housing;

f) said taper of said housing and said aligned, overlying position of said supplementary support structure defining an exterior dimension structured to permit concentrically stacked introduction of a plurality of the container assemblies within their respective hollow interiors, and g) said housing further comprising a recess structured to accommodate said supplementary support in said stored position and define a substantially uniform exterior surface between said housing and said supplementary support structure.

2. An assembly as recited in claim 1 further comprising a wheel assembly rotationally mounted on said housing and disposable in moveable engagement with a supporting surface and in supporting relation to said housing when traveling over the supporting surface.

3. An assembly as recited in claim 2 wherein said hollow interior of said housing is structured to accommodate said wheel assembly of a concentrically stacked container assembly therein.

4. An assembly as recited in claim 3 wherein said wheel assembly is disposed substantially beneath said closed end of said housing so as to minimize an overlap of said exterior dimension of said housing defined at said closed end.

5. An assembly as recited in claim 1 wherein said access opening is defined in a top of said housing.

* * * * *